US006419760B1

(12) United States Patent
Takemoto et al.

(10) Patent No.: US 6,419,760 B1
(45) Date of Patent: Jul. 16, 2002

(54) POWDER MAGNETIC CORE

(75) Inventors: Satoshi Takemoto, Ichinomiya; Takanobu Saito, Okazaki, both of (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/873,556

(22) Filed: Jun. 4, 2001

(30) Foreign Application Priority Data

Aug. 25, 2000 (JP) ..... 2000-255441

(51) Int. Cl.[7] ..... H01F 3/08
(52) U.S. Cl. ..... 148/306; 75/246
(58) Field of Search ..... 148/306, 307, 148/308; 75/230, 231, 246

(56) References Cited

U.S. PATENT DOCUMENTS 4,985,089 A * 1/1991 Yoshizawa et al. ..... 148/303
5,178,689 A * 1/1993 Kkamura et al. ..... 148/306
5,252,148 A * 10/1993 Shigeta et al. ..... 148/307
5,993,569 A * 11/1999 Simon et al. ..... 148/307

* cited by examiner

*Primary Examiner*—John Sheehan
(74) *Attorney, Agent, or Firm*—Frishauf, Holtz, Goodman & Chick, P.C.

(57) ABSTRACT

A powder magnetic core is made from powder containing Fe-based soft magnetic powder as a major component. Provided that an initial permeability of the core is $\mu_0$ and that a permeability of the core observed when a magnetic field of 24 kA/m is applied to the core is $\mu$, $\mu_0$ and $\mu$ fulfill the relationship $\mu/\mu_0 \geqq 0.5$. Specifically, the powder magnetic core is made from 60 to 75 volume % of soft magnetic powder having an aspect ratio ($L_2/L_1$) of 1 to 1.5 and the balance containing an insulating binder as a major component, and the content of the insulating binder is 5 to 20 parts by weight with respect to 100 parts by weight of the soft magnetic powder. The powder magnetic core shows a small reduction in the permeability even when the strength of a magnetic field applied thereto is increased.

1 Claim, 1 Drawing Sheet

FIGURE
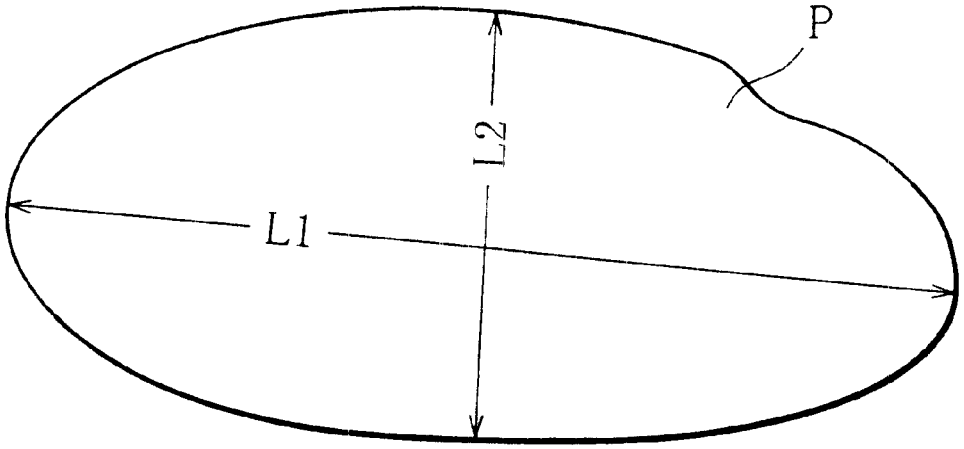

POWDER MAGNETIC CORE

BACK OF THE INVENTION

Field of the Invention

The present invention relates to a powder magnetic core, and more particularly, to a powder magnetic core which is designed to have low initial permeability so that the core may show high permeability when applied with high-intensity magnetic field and as a consequence may exhibit excellent direct-current bias characteristics.

Prior Art

Powder magnetic cores can be produced with high yield even if articles to be produced are small in size or complicated in shape, and thus have come to be widely used in place of conventionally popular laminated magnetic cores using silicon steel sheets.

Generally, a powder magnetic core is produced in the manner described below.

First, a soft magnetic alloy having a predetermined composition is subjected to mechanical crushing or atomizing to obtain powder (soft magnetic powder) with a predetermined particle size distribution.

Subsequently, the soft magnetic powder is admixed uniformly with predetermined amounts of an insulating material and a binder component so that the powder magnetic core to be obtained may have high electrical resistivity. The insulating material used in this case is, for example, oxide powder such as $Al_2O_3$ powder or $SiO_2$ powder, or nitride powder such as powder of AlN, $Si_3N_4$, or BN. As the binder component, water glass having electrical insulating properties or organic polymer such as silicone resin is used.

In the following description, the insulating material and the binder component are collectively referred to as the "insulating binder".

The mixture obtained in this manner is filled in a mold and compacted under a predetermined pressure, to obtain a green compact of powder magnetic core. At this time, in order to enhance the compactibility, the mixture is usually mixed with a predetermined amount of lubricant such as zinc stearate.

Lastly, the green compact is heat-treated to release the strain accumulated therein during the compaction, thereby obtaining a target powder magnetic core.

The powder magnetic core produced in this manner generally shows a magnetization curve (B-H curve) such that the magnetic induction gradually increases with increasing strength of a direct-current magnetic field (applied magnetic field) and is saturated when applied with a certain strength of magnetic field. Permeability (differential relative permeability) at a certain strength of direct-current magnetic field in the process of such gradual increase of the magnetic induction is defined as a value which is obtained by dividing a variation of the magnetic induction, observed when the magnetic field is slightly changed with a low-intensity alternating-current magnetic field superimposed on the direct-current magnetic field, by the slight change of the magnetic field. Accordingly, as the gradient of the B-H curve lessens, that is, as the strength of the applied magnetic field increases, the differential relative permeability decreases and thus the permeability lowers. After saturation magnetization is reached, the permeability virtually equals "1".

In the case of a high-permeability powder magnetic core produced using soft magnetic powder such as sendust powder as a material, if the powder magnetic core is used with a heavy current passed, an intense direct-current magnetic field is applied to the core, so that the magnetic induction of the core rapidly approaches saturated state. As a result, a problem arises in that the permeability decreases toward "1". Namely, this type of high-permeability powder magnetic core is poor in direct-current bias characteristics.

Generally, powder magnetic cores with an initial permeability of about 60 to 125 are put to practical use in various industrial fields. In the case of such powder magnetic cores, if a high-intensity magnetic field of, for example, 16 kA/m or above is applied, the permeability becomes extremely low, so that the cores cannot be put to actual use.

Thus, an effective measure to ensure the required level of permeability while at the same time suppress deterioration in the direct-current bias characteristics even with the application of a high-intensity magnetic field of 16 kA/m or above, for example, is to lower the initial permeability of a powder magnetic core to be produced.

It is generally known that the permeability of a powder magnetic core is a function of the density of the core. Accordingly, in view of the fact that a powder magnetic core with low density shows low permeability, it can be said that the initial permeability of a powder magnetic core can be effectively lowered by reducing the density of the core.

The following requirements should, however, be taken into consideration: The powder magnetic core should have magnetic characteristics such that the magnetic induction thereof increases with increasing strength of the applied magnetic field and that saturation magnetization is finally reached. The powder magnetic core, even though the initial permeability thereof is low, should have a saturation magnetic induction satisfying the required level for actual use. The powder magnetic core should be able to be manufactured with an industrially acceptable high yield.

OBJECT AND SUMMARY OF THE INVENTION

The present invention was made in view of the above requirements, and an object thereof is to provide a novel powder magnetic core of which the reduction in permeability is small even when applied with high-intensity magnetic field and which can therefore be used practically with an applied magnetic field of up to high intensity.

To achieve the above object, the present invention provides a powder magnetic core made from powder containing an Fe-based soft magnetic alloy as a major component, wherein, provided that an initial permeability of the powder magnetic core is $\mu_0$ and that a permeability of the powder magnetic core observed when a magnetic field of 24 kA/m is applied to the powder magnetic core is $\mu$, $\mu_0$ and $\mu$ fulfill a relationship of $\mu/\mu_0 \geqq 0.5$. More particularly, there is provided a powder magnetic core which is made from 60 to 75 volume % soft magnetic powder having an aspect ratio of 1 to 1.5 and the balance containing an insulating binder as a major component, wherein the content of the insulating binder is 5 to 20 parts by weight with respect to 100 parts by weight of the soft magnetic powder.

BRIEF DESCRIPTION OF THE DRAWING

FIG. 1 is a plan view of a soft magnetic particle, illustrating the definition of a major axis $L_1$, and a minor axis $L_2$, based on which an aspect ratio is calculated.

DETAILED DESCRIPTION OF THE INVENTION

A powder magnetic core according to the present invention is a bulk body with a certain density, produced by compacting a mixture of soft magnetic powder having certain dimensional characteristics, as described later, and an insulating binder, also described later, and heat-treating the compacted mixture. Accordingly, the powder magnetic core has a skeletal structure such that particles of the soft magnetic powder coated with the insulating binder are bonded together by the insulating binder, and also has a constitutional structure such that fine voids are distributed within the core.

In the powder magnetic core of the present invention having the above constitutional structure, the volumetric proportion of the soft magnetic powder is set to fall within a range of 60 to 75 volume %. Consequently, the volumetric proportion of the balance containing the insulating binder as a major component plus a total volume of the fine voids accounts for 25 to 40 volume %.

Also, the powder magnetic core according to the present invention has magnetic characteristics such that, provided the initial permeability is $\mu_0$ and a permeability of the core applied with a magnetic field of 24 kA/m is $\mu$, $\mu_0$ and $\mu$ fulfill the relationship $\mu/\mu_0 \geqq 0.5$.

Namely, although the initial permeability of the powder magnetic core is low, reduction in the permeability is small even when the core is applied with high-intensity magnetic field. Specifically, even when the powder magnetic core is applied with a high-intensity magnetic field of 24 kA/m, the core retains a permeability ($\mu$) of not smaller than 50 % of the initial permeability ($\mu_0$).

Such magnetic characteristics can be obtained by satisfying requirements described below.

The soft magnetic powder used in this case should preferably be such that particles thereof have an aspect ratio falling within a range of 1 to 1.5, as defined below.

If the soft magnetic particles have an aspect ratio greater than 1.5, the demagnetization factor of the powder becomes small, increasing the initial permeability ($\mu_0$) of the resulting powder magnetic core. As a result, significant reduction in the permeability is caused when high-intensity magnetic field is applied; in other words, the relationship $\mu/\mu_0 \geqq 0.5$ fails to be fulfilled.

The aspect ratio referred to herein represents a value measured as described below.

Aspect ratio $=L_2/L_1$ where $L_1$ is defined as the length of a major axis of a particle P, as shown in FIG. 1, and $L_2$ is defined as the length of a minor axis which is a line passing through the middle point of $L_1$ perpendicularly to $L_1$ and terminating at points where the line intersects the outer periphery of the particle.

Accordingly, a particle with an aspect ratio of "1" is a spherical body and the calculated aspect ratio cannot take a value smaller than "1".

The soft magnetic powder to be used in the present invention may be of any kind insofar as the powder used is Fe-based soft magnetic alloy powder and has the aforementioned dimensional characteristics. Such Fe-based soft magnetic alloys include, for example, Fe-3% Si alloy, Fe-6.5% Si alloy, Fe-9.5% Si-5.5% Al (sendust) alloy, Fe-47% Ni alloy, and Fe-1% to 18% Cr alloy (all in mass %).

In the powder magnetic core of the present invention, the proportion of the powder having the above dimensional characteristics is so restricted as to account for a range of 60 to 75 volume %.

If the proportion of the powder is higher than 75 volume %, the initial permeability ($\mu_0$) of the resulting powder magnetic core increases, so that the permeability ($\mu$) of the core when applied with high-intensity magnetic field is low. Specifically, the relationship $\mu/\mu_0 \geqq 0.5$ fails to be satisfied.

On the other hand, if the proportion of the powder is lower than 60 volume %, then the proportion of the insulating binder etc. becomes relatively high and also the total volume of fine voids increases. From the point of view of magnetic characteristics, therefore, the initial permeability and the saturation magnetic induction decrease and the direct-current bias characteristics are deteriorated, with the result that the permeability ($\mu$) of the resulting powder magnetic core when applied with high-intensity magnetic field lowers. In other words, the relationship $\mu/\mu_0 \geqq 0.5$ fails to be fulfilled. In addition, the resulting powder magnetic core has relatively high porosity as a whole, and thus it cannot be said that the strength of the core is sufficiently high.

The powder magnetic core contains, besides the soft magnetic powder, the insulating binder and other components. The insulating binder that can be used in the present invention is not particularly limited and may be a substance conventionally used, such as water glass, silicone resin, phosphoric acid, phenolic resin, or polyimide resin.

Preferably, however, the content of the insulating binder is set to 5 to 20 parts by weight, significantly higher than in the case of conventional powder magnetic cores, with respect to 100 parts by weight of the aforementioned soft magnetic powder.

Since the content of the insulating binder is thus increased to a large extent, the powder magnetic core of the present invention has low density and hence shows small initial permeability ($\mu_0$).

If the content of the insulating binder is lower than 5 parts by weight, the density of the resulting powder magnetic core cannot be reduced satisfactorily and the initial permeability ($\mu_0$) increases, so that the permeability ($\mu$) of the core when applied with high-intensity magnetic field is low. Specifically, the relationship $\mu/\mu_0 \geqq 0.5$ fails to be fulfilled.

If, on the other hand, the content of the insulating binder is higher than 20 parts by weight, the proportion of the soft magnetic powder becomes relatively low, though the density and initial permeability ($\mu_0$) of the resulting powder magnetic core can be reduced. This results, for example, in the difficulty in attaining the required saturation magnetic induction or in cracking of the core during the compaction, increasing the fraction defective.

The powder magnetic core according to the present invention can be produced in a conventional manner, by mixing the aforementioned components, then compacting the mixture, and heat-treating the compact. Examples 1–10 & Comparative Examples 1–6

Soft magnetic powder having a composition of Fe-9.5% Si-5.5% Al (sendust alloy composition) and having a particle size of 100 mesh or less was prepared by an atomizing process using gas and water. In this case, the operating conditions for the atomizing process were changed to obtain powders with different aspect ratios as shown in Table 1 below.

Subsequently, the powders were admixed with respective proportions (parts by weight) of water glass, as shown in Table 1, with respect to 100 parts by weight of the respective powders, and were mixed further with 0.5 parts by weight zinc stearate (lubricant).

The mixtures were then compacted under a pressure of 0.49 to $1.96\times10^3$ MPa, to obtain ring-shaped compacts with an outer diameter of 28 mm, an inner diameter of 20 mm and a height of 5 mm. These compacts were heat-treated in a vacuum at 800° C. for one hour to obtain powder magnetic cores.

The bulk densities of the powder magnetic cores obtained in this manner were measured, and then with a primary coil with 40 turns and a secondary coil with 20 turns wound respectively on each core, the permeability was measured under the following conditions:

(1) Initial permeability ($\mu 0$): Using a 42841A precision LCR meter from YHP Corporation, the initial permeability was measured as a differential relative permeability observed with an alternating-current magnetic field with an intensity of 4 A/m and a frequency of 20 kHz applied to each powder magnetic core.

(2) Permeability ($\mu$) at applied magnetic field of 24 kA/m: The permeability ($\mu$) of each powder magnetic core wound a primary coil with 300 turns was measured, also using the 42841A precision LCR meter from YHP Corporation, as a differential relative permeability which was observed with an alternating-current magnetic field with an intensity of 4 A/m and a frequency of 20 kHz superimposed on a bias direct-current magnetic field with an intensity of 24 kA/m.

The results of the measurements are collectively shown in Table 1.

TABLE 1

| | Aspect | Powder magnetic core | | | Magnetic characteristics | | |
|---|---|---|---|---|---|---|---|
| | ratio of Fe - 9.5% Si - 5.5% Al powder used | Proportion of water glass* | Proportion of Fe - 9.5% Si - 5.5% Al powder (volume %) | Bulk density (g/cm$^3$) | Initial Permeability ($\mu_0$) | Permeability ($\mu$) at applied magnetic field of 24 kA/m | $\mu/\mu_0$ |
| Example 1 | 1.1 | 6 | 73 | 5.3 | 25 | 16 | 0.64 |
| Example 2 | 1.1 | 9 | 71 | 5.3 | 22 | 14 | 0.64 |
| Example 3 | 1.1 | 12 | 70 | 5.2 | 20 | 13.5 | 0.68 |
| Example 4 | 1.1 | 15 | 67 | 5.1 | 16 | 10.5 | 0.66 |
| Example 5 | 1.1 | 19 | 64 | 5.0 | 12.5 | 7.3 | 0.58 |
| Example 6 | 1.3 | 12 | 67 | 5.0 | 22 | 14 | 0.64 |
| Example 7 | 1.4 | 12 | 64 | 4.9 | 26 | 16.5 | 0.63 |
| Example 8 | 1.4 | 19 | 63 | 4.8 | 18 | 10 | 0.56 |
| Example 9 | 1.1 | 9 | 62 | 4.6 | 11 | 7.2 | 0.65 |
| Example 10 | 1.1 | 9 | 74 | 5.5 | 28 | 17.5 | 0.63 |
| Comparative Example 1 | 1.1 | 4 | 77 | 5.4 | 38 | 8.3 | 0.22 |
| Comparative Example 2 | 1.1 | 21 | 57 | 4.7 | 8.5 | 4 | 0.47 |
| Comparative Example 3 | 1.7 | 12 | 64 | 4.9 | 36 | 8 | 0.22 |
| Comparative Example 4 | 1.7 | 19 | 61 | 4.7 | 32 | 7 | 0.22 |
| Comparative Example 5 | 1.1 | 9 | 58 | 4.3 | 9 | 4 | 0.44 |
| Comparative Example 6 | 1.1 | 9 | 78 | 5.7 | 50 | 5 | 0.10 |

*In parts by weight with respect to 100 parts by weight of the Fe - 9.5% Si - 5.5% Al powder.

Table 1 reveals the following:

(1) Comparative Example 1 containing a lower proportion of the insulating binder than the range defined in the present invention is high in bulk density and initial permeability, and shows a significantly large degree of reduction in the permeability when applied with high-intensity magnetic field. In the case of Comparative Example 2 containing a higher proportion of the insulating binder than the range defined in the present invention, cracking was observed and the core was found to be defective. From the above it follows that the content of the insulating binder should be 5 to 20 parts by weight with respect to 100 parts by weight of the soft magnetic powder.

(2) Comparison between Example 7 and Comparative Example 3 clearly reveals that, although the conditions were the same except that the Fe-9.5% Si-5.5% Al powder used in Comparative Example 3 had an aspect ratio outside the range defined in the present invention, Comparative Example 3 showed higher initial permeability than Example 7 and also exhibited lower permeability than Example 7 when applied with high-intensity magnetic field. This proves that the soft magnetic powder to be used should have an aspect ratio falling within a range of 1 to 1.5

(3) Comparative Example 1 contained a higher proportion of the Fe-9.5% Si-5.5% Al powder than 75 volume % defined in the present invention, while Comparative Examples 2 and 5 contained lower proportions of the Fe-9.5% Si-5.5% Al powder than 60 volume % defined in the present invention. Comparison between Comparative Example 1 and Example 1 which contained a proportion of the Fe-9.5% Si-5.5% Al powder falling within the range defined in the present invention clearly reveals that Comparative Example 1 showed higher initial permeability than Example 1 and also exhibited a much greater degree of reduction in the permeability than Example 1 when applied with high-intensity magnetic field. In the case of Comparative Examples 2 and 5, although the initial permeability was low, a large reduction in the permeability was observed when high-intensity magnetic field was applied. From the above it follows that the volumetric proportion of the soft magnetic powder should be within a range of 60 to 75 volume %.

As is clear from the above description, the powder magnetic core according to the present invention has low initial permeability; nevertheless it shows a small degree of reduction in the permeability even when applied with high-intensity magnetic field.

The powder magnetic core of the present invention is therefore useful when applied to heavy-current choke coils or inductors.

What is claimed is:

1. A powder magnetic core containing:

60 to 75 volume of a powder, the powder including an Fe-based soft magnetic alloy and having an aspect ratio of 1 to 1.5; and a balance including an insulating binder, a weight ratio of the insulating binder to the powder being 0.05 to 0.2, said powder magnetic core fulfilling a relationship represented by a following formula:

$$\mu/\mu_0 \geqq 0.5$$

wherein $\mu_0$ denotes an initial permeability of said powder magnetic core and $\mu$ denotes a permeability of said powder magnetic core at a magnetic field of 24 kA/m.

* * * * *